US007486026B2

(12) United States Patent
Johnston et al.

(10) Patent No.: US 7,486,026 B2
(45) Date of Patent: Feb. 3, 2009

(54) DISCHARGE LAMP WITH HIGH COLOR TEMPERATURE

(75) Inventors: Colin W. Johnston, Beachwood, OH (US); James A. Leonard, Shaker Heights, OH (US); Deeder Aurongzeb, Mayfield Heights, OH (US); Kazuya Abe, Koga (JP); Makoto Kozawa, Koga (JP)

(73) Assignees: General Electric Company, Schenectady, NY (US); Koto Electric Co., Ltd., Tokyo (JP)

( * ) Notice: Subject to any disclaimer, the term of this patent is extended or adjusted under 35 U.S.C. 154(b) by 0 days.

(21) Appl. No.: 11/595,632

(22) Filed: Nov. 9, 2006

(65) Prior Publication Data

US 2008/0111489 A1 May 15, 2008

(51) Int. Cl.
*H01J 17/20* (2006.01)

(52) U.S. Cl. ..... 313/641; 313/637; 313/571

(58) Field of Classification Search ..... 439/615, 439/739; 445/24, 26, 2, 29, 22
See application file for complete search history.

(56) References Cited

U.S. PATENT DOCUMENTS

| | | | | |
|---|---|---|---|---|
| 3,654,506 | A * | 4/1972 | Kuhl et al. | 313/641 |
| 4,134,039 | A | 1/1979 | Vida et al. | |
| 4,647,814 | A | 3/1987 | Dobrusskin et al. | |
| 5,013,968 | A * | 5/1991 | Russell et al. | 313/641 |
| 5,220,244 | A | 6/1993 | Maseki et al. | |
| 5,264,760 | A | 11/1993 | Genz et al. | |
| 5,323,085 | A * | 6/1994 | Genz | 313/570 |
| 5,451,838 | A * | 9/1995 | Kawai | 313/638 |
| 5,646,472 | A | 7/1997 | Horikoshi | |
| 5,668,441 | A | 9/1997 | Genz | |
| 5,723,944 | A * | 3/1998 | Higashi et al. | 313/570 |
| 5,798,612 | A | 8/1998 | Dirks | |
| 5,929,563 | A * | 7/1999 | Genz | 313/571 |
| 5,965,984 | A | 10/1999 | Horiuchi et al. | |
| 6,570,328 | B1 * | 5/2003 | Steinmann | 313/634 |
| 6,731,068 | B2 * | 5/2004 | Dakin et al. | 313/640 |
| 6,965,202 | B2 * | 11/2005 | Hataoka et al. | 313/623 |
| 7,198,534 | B2 * | 4/2007 | Takahashi et al. | 445/26 |
| 7,268,495 | B2 * | 9/2007 | Rintamaki et al. | 313/640 |
| 2004/0056593 | A1 * | 3/2004 | Eastlund et al. | 313/567 |

FOREIGN PATENT DOCUMENTS

| | | | |
|---|---|---|---|
| CA | 2 156 472 | A1 | 3/1996 |
| EP | 0 634 780 | B1 | 1/1997 |
| EP | 0 605 248 | B1 | 11/2001 |
| JP | 06 342641 | A | 12/1994 |

OTHER PUBLICATIONS

PCT/US2007/083121 International Search Report, mailed Jul. 11, 2008.

* cited by examiner

*Primary Examiner*—Sikha Roy
*Assistant Examiner*—Donald L Raleigh
(74) *Attorney, Agent, or Firm*—Fay Sharpe LLP

(57) ABSTRACT

A lamp includes a discharge sustaining fill which includes cesium halide, one of indium halide and thallium halide, optionally gadolinium halide and a rare earth halide component selected from dysprosium halide, holmium halide, thulium halide, and neodymium halide. In operation without a jacket, the lamp may have a color temperature of from 7,000K to 14,000K and a color rendering index of at least 70 when operated at an arc wall loading in excess of about 2 W/mm$^2$.

20 Claims, 1 Drawing Sheet

DISCHARGE LAMP WITH HIGH COLOR TEMPERATURE

BACKGROUND OF THE INVENTION

The present embodiment relates to a high intensity discharge lamp (HID). More particularly, it relates to a metal halide lamp having a high color temperature and high color rendering index.

Metal halide lamps typically have a quartz, polycrystalline alumina (PCA), or a single crystal alumina (sapphire) arc discharge vessel filled with a mixture of gases, and surrounded by a protective envelope. The fill includes light emitting elements such as sodium and rare earth elements, such as scandium, indium, dysprosium, neodymium, praseodymium, and cerium in the form of a halide, with mercury, and generally an inert gas, such as krypton, argon or xenon. Metal halide lamps are disclosed, for example, in U.S. Pat. Nos. 4,647,814; 5,929,563; 5,965,984; and 5,220,244. While lamps of this type having an outer jacket or envelope have been formed with relatively high color temperatures, unjacketed arc tubes (in which the discharge chamber is in direct contact with the atmosphere, generally have a much lower color temperature.

The entertainment industry desires bright, white light compact sources that enable efficient collection and focusing of the light to produce multiple effects such as the projection of Gobos, color patterns, and moving lights. However, at high wall loadings, color temperatures are generally low.

There remains a need for a lamp which can run at a high color temperature with a good color rendering with a high wall loading without a jacket.

BRIEF DESCRIPTION OF THE INVENTION

In one aspect of the invention, a lamp includes a discharge vessel. Electrodes extend into the discharge vessel. A discharge sustaining fill is sealed within the discharge vessel. The fill includes mercury, an inert gas; and a halide component including cesium halide, at least one of indium halide and thallium halide, optionally gadolinium halide, and a rare earth halide component including at least one of dysprosium halide, holmium halide, thulium halide, and neodymium halide, wherein in operation without a jacket at an arc wall loading of at least 2 watts/mm$^2$, the lamp has a color temperature of from 7000K to 14,000K and a color rendering index (Ra) of at least 70.

In another aspect, a lamp includes a discharge vessel. Electrodes extend into the discharge vessel. A discharge sustaining fill is sealed within the discharge vessel. The fill includes mercury, an inert gas, and a halide component. The halide component includes cesium halide, at least one of indium halide and thallium halide, gadolinium halide, and at least one rare earth halide selected from dysprosium halide, holmium halide, thulium halide, and neodymium halide, the fill satisfying the expression:

$$0.2 \leq \frac{Re}{(Gd + In + Tl)} \leq 2.0$$

wherein: Re=moles of rare earth halides in the fill selected from the group consisting of dysprosium, neodymium, holmium, and thulium halides, and combinations thereof;

Gd=moles of gadolinium halides in the fill,

In=moles of indium halides in the fill, and

Tl=moles of thallium halides in the fill.

DETAILED DESCRIPTION OF THE INVENTION

Figure 1:
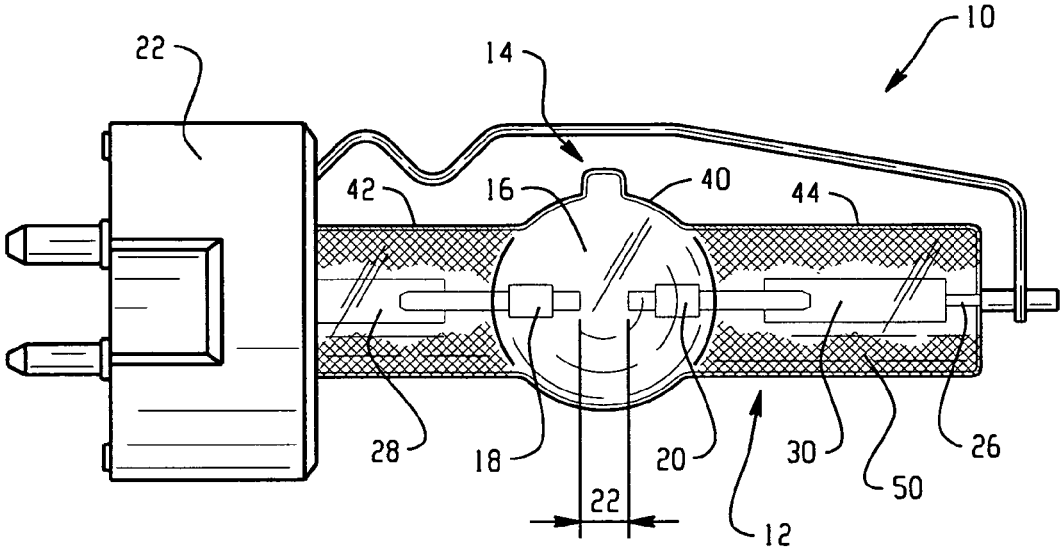
FIG. 1 is a schematic cross sectional view of a lamp according to the exemplary embodiment.

Aspects of the exemplary embodiment relate to a lamp including a discharge vessel which contains a discharge sustaining fill comprising mercury, a noble gas, such as xenon or argon, and a metal halide (ReX) component which includes halides of cesium, at least one of indium and thallium, and a rare earth halide selected from the group consisting of gadolinium, dysprosium, holmium, thulium, and neodymium. In general, at least one of gadolinium and neodymium is present in the fill. In one embodiment, by controlling the fill composition such that:

$$\frac{Gd + Y}{P_{ARC}\Sigma} > R \qquad \text{Eqn. 1}$$

where Gd=the moles of gadolinium halide in the fill;

Y=In+Tl, where In=the moles of indium halide in the fill and Tl=the moles of thallium halide in the fill;

$P_{ARC}$ is the arc wall loading in W/mm$^2$;

$\Sigma$=the total moles of metal halide in the fill; and

R≧0.1 MM$^2$/W;

the exemplary lamp may have a Correlated Color Temperature (CCT) of at least about 7000K, a color rendering index of at least 65, and an efficacy of at least 55 lumens per watt (lm/W), in a compact discharge vessel, free of an outer jacket, where the outer side of the discharge vessel is in contact with free (atmospheric) air. Such a lamp is able to operate at extremely high arc wall loadings, e.g., greater than 2 W/mm$^2$, while retaining these advantageous properties.

In one embodiment, where the number of moles of Gd exceeds the total number of moles of In and Tl (e.g., Gd≧2Y, or Y=0), and where the number of moles of In exceeds the number of moles of Tl (e.g., In≧Tl, or Tl=0), the value of R in Eqn. 1 may be 0.10, or higher, e.g., at least 0.12. This may be the case, for example where Eqn. 1 is satisfied and no Thallium present.

In another embodiment, where the number of moles of Gd exceeds the total number of moles of In and Tl (e.g., Gd≧2Y, or Y=0), and where the number of moles of Tl exceeds the number of moles of In (e.g., Tl≧In, or In=0), the value of R in Eqn. 1 may be 0.15, or higher. e.g., at least 0.18. This may be the case, for example, when Indium is present.

In another embodiment, where the number of moles of Gd is less than the total number of moles of In and Tl (e.g., Y≧1.8Gd, or Gd=0), and where the number of moles of In exceeds the number of moles of Tl (e.g., In≧2Tl, or Tl=0), the value of R in Eqn. 1 may be 0.15, or higher. This may be the case, for example, when Eqn. 1 is satisfied and no Gadolinium or Thallium is present and R is about 0.15-0.22.

In one embodiment, the fill satisfies following molar ratio:

$$0.2 \leq \frac{Re}{(Gd + In + Tl)} \leq 2 \qquad \text{Eqn. 2}$$

wherein: Re=moles of rare earth halides in the fill selected from the group consisting of dysprosium, neodymium, holmium, and thulium halides, and combinations thereof;

Gd=moles of gadolinium halides in the fill,

In=moles of indium halides in the fill, and

Tl=moles of thallium halides in the fill.

In one specific embodiment, the fill satisfies following molar ratio:

$$0.3 \leq \frac{Re}{(Gd + In + Tl)} \leq 0.8$$

For example $$0.5 \leq \frac{Re}{(Gd + In + Tl)} \text{ and/or } \frac{Re}{(Gd + In + Tl)} \leq 0.7$$

In another specific embodiment, the fill further satisfies following molar ratio:

$$0.38 \leq \frac{Cs}{Re} \leq 0.48 \qquad \text{Eqn. 3}$$

wherein Cs=moles of cesium halides in the fill.

An exemplary fill for the lamp which includes gadolinium in a significant amount and which satisfies Eqn. 2 includes:

| Halide | Fill concentration in micromoles/cubic centimeter (μmol/cm$^3$) |
|---|---|
| cesium | 0.12-0.5, e.g., ≧0.14 |
| gadolinium | 0.30-2.0, e.g., ≧0.35 |
| indium and/or thallium | 0.1-1.6, e.g., ≧0.3 |
| Rare earths (Re, as defined above) | 0.3-1.5, e.g., ≧0.75 |
| Other halides (excluding Hg halide) (total), | ≦0.2, e.g., ≦0.1 |

In this example, the total concentration of dysprosium, holmium and thulium halides may range from 0 to about 0.8, e.g., at least 0.2 μmol/cm$^3$. Neodymium halide may range from 0 to about 1.0 μmol/cm$^3$, e.g., at least 0.15 μmol/cm$^3$. Mercury halide may range from 0 to about 1.0 umol.cc, e.g., about 0.6 umol/cc.

Another exemplary fill for the lamp which satisfies Eqn. 2 and which includes little or no gadolinium halide in the fill includes:

| Halide | Fill concentration in μmol/cm$^3$ |
|---|---|
| cesium | 0.12-0.25, e.g., ≧0.14 |
| gadolinium | ≦0.30, e.g., ≦0.20, e.g., ≦0.05 |
| indium and/or thallium | 0.8-4.5 |
| Rare earths (Re) | 0.30-0.8 |

In this embodiment, dysprosium halides, where present, may range from 0.2-0.4 μmol/cm$^3$. Neodymium halides, where present may range from 0.1-0.5 μmol/cm$^3$.

$P_{ARC}$, the arc wall loading, is the lamp power per unit area of the interior of the discharge vessel, as measured between the electrodes, i.e., $$P_{ARC} = \frac{P_{LAMP}}{2\pi r_{LAMP} \text{arc}_{GAP}}$$

where $P_{LAMP}$ is the lamp power in Watts, $r_{LAMP}$ is the radius of the discharge vessel and $\text{arc}_{GAP}$ is the distance between the electrodes. If $r_{LAMP}$ and $\text{arc}_{GAP}$ are expressed in mm, $P_{ARC}$ is expressed in W/mm$^2$. $P_{ARC}$ may be, for example, at least 2 W/mm$^2$, e.g., about 3 W/mm$^2$ or higher. The arc wall loading may be at least 3.2 W/mm$^2$ and in some embodiments, may be up to about 5 W/mm$^2$, or higher. In one specific embodiment, $P_{ARC}$ is less than about 4.5. For arc wall loading calculations, even though the discharge vessel may be curved between the electrodes, it may be approximated as a cylinder (having an r value corresponding to an average r value) for arc wall loading calculations.

In one embodiment, the lamp is a compact lamp having an internal volume of less than 5 cm$^3$, e.g., about 3 cm$^3$, or less.

Correlated Color Temperature (CCT) is defined as the absolute temperature, expressed in degrees Kelvin (K), of a black body radiator when the chromaticity (color) of the black body radiator most closely matches that of the light source. CCT may be estimated from the position of the chromatic coordinates (u, v) in the Commission Internationale de l'Éclairage (CIE) 1960 color space. As the temperature rises, the color appearance shifts from yellow to blue. From this standpoint, the CCT rating is an indication of how "warm" or "cool" the light source is. The higher the number, the cooler the lamp. The lower the number, the warmer the lamp. The CCT can be at least 9000K or 10,000K in some embodiments and can be up to about 14,000K. Above this temperature, the light may have an overly bluish tinge, which is undesirable for many applications.

The efficacy of a lamp is the luminous flux divided by the total radiant flux, expressed in units of lumens per Watt. It is a measure of how much of the energy supplied to the lamp is converted to visible light. The efficacy can be at least 80 lm/W in some embodiments and can be up to about 90 lm/W, or higher.

The color rendering index (CRI) is an indication of a lamp's ability to show individual colors relative to a standard. This value is derived from a comparison of the lamp's spectral distribution compared to a standard (typically a black body) at the same color temperature. There are fourteen special color rendering indices (Ri where i=1-14) which define the color rendering of the light source when used to illuminate standard color tiles. The general colour rendering index (Ra) is the average of the first eight special color rendering indices (which correspond to non-saturated colors) expressed on a scale of 0-100. Unless otherwise indicated, color rendering is expressed herein in terms of the Ra. The color rendering index can be at least 65, in some embodiments, at least 70, and in specific embodiments, at least 75. In some embodiments, the color rendering index may be up to about 90, or higher, in other embodiments, up to about 85.

The value of R, which represents the minimum molar ratio of gadolinium plus indium and thallium to the total moles of metal halide in the fill per watt of arc power per unit wall area in mm$^2$ between the electrodes, can be at least 0.1 W/mm$^2$, e.g., at least 0.15, and in some embodiments, can be at least 0.20, or at least 0.25. R can be up to about 0.50 and in some embodiments, is less than 0.30.

The exemplary lamps have a high CCT and Ra. Combined with a small arc gap and a transparent discharge vessel, the fill provides improved performance of the system by providing better color rendering, higher brightness, better optical control, and more uniform beam than in conventional lamps. Higher CCT, at least as high as 9000K, is perceived as whiter and brighter, than lower CCT lamps of comparable power or lumen output. This makes this lamp desirable for entertainment lighting such as moving head lights.

Figure 2:
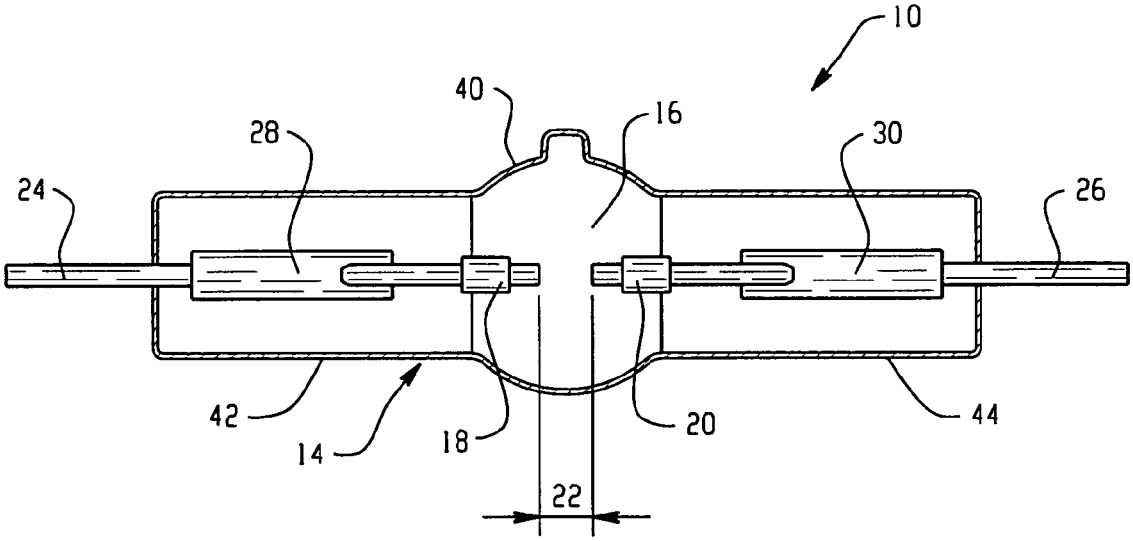
FIG. 2 is an enlarged schematic view of the discharge vessel of the lamp of FIG. 1.

With reference to FIGS. 1 and 2, an exemplary electric lamp 10 which provides the above-mentioned properties includes a light source 12, such as a double-ended halogen tube. The tube 12 includes a light transmissive discharge vessel or envelope 14, which is typically formed from a transparent vitreous material, such as quartz, fused silica, or aluminosilicate. The exemplary discharge vessel 14 is formed of a high temperature resistant, light permeable material formed as a single component. The discharge vessel 14 defines an internal chamber 16. The discharge vessel 14 may be coated with a UV or infrared reflective coating as appropriate. The exemplary lamp 10 may be a high intensity discharge (HID) lamp, which operates at a wattage of at least about 250 W, e.g., at least about 400 W or at least 700 W, and in one embodiment, at least about 1000 W, e.g., up to about 4 kW, or higher.

Hermetically sealed within the chamber 16 is a halogen fill, typically comprising mercury, an inert gas, such as xenon or krypton, and a halide component. The halide component will be described in greater detail below. A pair of internal electrodes 18, 20 extends coaxial with the lamp axis into the chamber 16 from opposite ends thereof and defines a gap 22 of distance $arc_{GAP}$ for supporting an electrical discharge during operation of the lamp. The $arc_{GAP}$ may be, for example, from about 3 mm to about 5 cm, e.g., about 3 mm to about 1 cm, and in one embodiment, about 4 mm.

The internal electrodes 18, 20 may be formed primarily from an electrically conductive material, such as tungsten. The electrode surface area may be optimized for current density. The internal electrodes 18, 20 are electrically connected with external connectors 24, 26 by foil connectors 28, 30 at a pinch zone. The illustrated external connectors 24, 26 extend outwardly to bases (not shown) at respective ends of the discharge vessel 14 for electrical connection with a source of power as shown in FIG. 2, or may be connected with a single-ended base 32, as shown in FIG. 1. Connectors 24, 26 may be in the shape of pins or tubes and may be formed primarily from an electrically conductive material, such as molybdenum or niobium or alloy thereof.

During assembly of the lamp, the vitreous discharge vessel material is sealed, for example, by pinching the vitreous material, in the region of the foil connectors 28, 30, to form seals.

The illustrated lamp discharge vessel 14 includes a bulbous central portion 40 and opposed stem portions or legs 42, 44, which extend outwardly from the bulbous central portion along the longitudinal axis of the lamp 10. Other lamp configurations are also contemplated. For example, the lamp discharge vessel 14 may have a substantially constant cross-sectional diameter. The foil connectors 28, 30 are situated in the thinned stem portions 42, 44. The foil connectors 28, 30 may be welded, brazed, or otherwise connected at ends thereof to the respective external connectors 24, 26 and internal electrodes 18, 20. Optionally, a frosting 50 on the legs 42, 44 reduces temperatures at the pinch region.

The lamp may be mounted in a fixture, such as a reflective housing. The housing may be open to the atmosphere or hermetically sealed with a lens or cover to provide a jacket for the lamp.

The fill provides the desired CCT and CRI properties without the need for a jacket. This enables the lamp to have a high efficacy. The lamp is suited to applications such as theater and concert illumination (with or without a reflector) and in other applications where visible radiation is used for establishing mood or atmosphere or for projection of images whether static or dynamic. The high color temperature achieved by this invention results in a higher perceived brightness by the user than would otherwise be experienced for a product with identical performance save for a lower color temperature.

The halides in the fill may be bromides, iodides, or a combination thereof. The halide component may include at least one rare earth halide selected from gadolinium, dysprosium, and neodymium, and in one embodiment, at least two of these three rare earth halides. In one embodiment, dysprosium is present in the fill. Holmium, and/or thulium halides may also be present in the fill, e.g., as substitutes for a portion of the dysprosium. Thus, where dysprosium is mentioned as a halide, these elements are also encompassed, unless specifically mentioned otherwise. Since Dy, Ho, and Tm have similar emission spectra, they can be substituted for each other in an approximately 1:1 ratio with little change in the color point (CCx, CCy, CCT) or CRI. For example, the fill may include gadolinium, dysprosium, and optionally neodymium or the rare earths may comprise dysprosium and neodymium without gadolinium. The rare earth halide may contribute a total of at least 10 mol % of the halides in the fill, and in one embodiment, at least 40 mol %, and can be up to about 85 mol %, e.g., less than about 75 mol % of the halides in the fill. In one embodiment, gadolinium and neodymium halides together total at least 4 mol % of the fill, and in some embodiments, at least 25 mol % or at least 30%. The gadolinium and neodymium halides may total up to about 65 mol % of the halides in the fill. %. The dysprosium and neodymium halides may total up to about 55 mol % of the halides in the fill.

The halide component optionally includes cesium halide. Where present, the cesium halide may be at a molar concentration of at least about 3 mol %, and in one embodiment, less than about 15 mol % of the total halides in the fill. In some embodiments, cesium halides make up at least about 10 mol % of the halides in the fill.

The halide component includes one or more of indium and thallium halides at a total molar concentration of at least about 15 mol %, and in one embodiment, less than about 85 mol % of the total halides in the fill. In some embodiments, where gadolinium halides are at least about 10 mol %, the total of indium and thallium halides is less than about 50%.

The halide component optionally includes mercury halide. Where present, the mercury halide may be at a molar concentration of at least about 3 mol %, and in one embodiment, less than about 20 mol % of the total halides in the fill. In some embodiments, mercury halides make up at least about 10 mol % of the halides in the fill.

Expressed as molar percents (number of moles of halide divided by the total moles of halide in the fill), the fill may comprise:

| Halide | Mol % |
|---|---|
| Gadolinium | 0-55, e.g., at least 10% e.g., less than 50% |
| Dysprosium | 5-55, e.g., at least 8%, e.g., less than 35% |
| Neodymium | 0-30, e.g., at least 5% e.g., less than 18% |
| Cesium | 0-25 e.g., less than 18% |
| Indium | 0-85, e.g., at least 10%, when thallium is absent e.g., less than 40% |
| Thallium | 0-35, e.g., at least 10%, when indium is absent, e.g., less than 25% |

In a first exemplary embodiment, the fill includes halides of dysprosium (e.g., one or more of dysprosium, thulium and holmium), gadolinium, cesium and indium. Other halides (not including mercury halide) may account for a total of less than 10 mol % of the fill, e.g., less than about 5%, and in one embodiment, about 0%. In this embodiment, the molar ratio of dysprosium halide to gadolinium halide may be about 1.8:3 to about 2.4:3, e.g., about 2:3. The molar ratio of dysprosium halide to cesium halide may be at least 2:1. The molar ratio of dysprosium halide to indium halide may be from about 1.5:1 to about 2.5:1, e.g., about 2:1. The molar ratio of Dy:Gd:Cs:In may be about 2:3:1:1, i.e. for every two moles of Dy (or substituted Ho or Tm), there are about 3 moles of Gd, about than 1 moles of Cs and about 1 mol of In. For example, a fill comprising dysprosium, gadolinium, cesium and indium at concentrations of about 0.35, 0.44, 0.20, and 0.16 μmol/cm$^3$ (e.g., in which each of these concentrations may vary by no more than ±15%, e.g., less than 10%, or less than 5%) respectively, may be provided.

Unjacketed lamps formed according to this embodiment may have a CCT of at least 7000K, a color rendering of at least 65, and an efficacy of at least 80 lm/W with a power consumption which exceeds e.g., about 700 W.

In a second exemplary embodiment, the fill includes halides of dysprosium (e.g., one or more of dysprosium, thulium and holmium), gadolinium, cesium and thallium. Other halides may account for a total of less than 10 mol % of the fill, e.g., less than about 5%, and in one embodiment, about 0%. In this embodiment, the molar ratio of dysprosium to gadolinium may be about 0.8:2 to about 1.2:2, e.g., 1:2, the ratio of dysprosium to cesium at least 2:1, and the ratio of dysprosium to thallium may be about 0.9:1 to about 1.2:1, e.g., about 1:1. For example, a fill comprising dysprosium, gadolinium, cesium, and thallium at concentrations of about 0.31, 0.59, 0.15, and 0.27 μmol/cm$^3$ (e.g., in which each of these concentrations may vary by no more than ±15%, e.g., less than 10%, or less than 5%) respectively, may be provided. Unjacketed lamps formed according to this embodiment may have a CCT of at least 7500K, a color rendering index of at least 80, and an efficacy of at least 70 lm/W.

In a third exemplary embodiment, the halide fill comprises halides of dysprosium (e.g., one or more of dysprosium, thulium and holmium), neodymium, gadolinium, cesium and indium. Other halides (other than mercury) may account for a total of less than 10 mol % of the fill, e.g., less than about 5%. In this embodiment, the molar ratio of dysprosium to neodymium may be about 2.6:2 to about 3.4:2, e.g., about 3:2, the ratio of dysprosium to gadolinium about 0.8:1 to 1.2:1, e.g., about 1:1, the ratio of dysprosium to cesium at least 3:2, and the ratio of dysprosium to indium about 0.8:1 to about 1.5:1, e.g., about 1:1. For example, a fill comprising dysprosium, neodymium, gadolinium, cesium and indium at concentrations of about 0.7, 0.5, 0.7, 0.5, and 1.5 μmol/cm$^3$ (e.g., in which each of these concentrations may vary by no more than ±15%, e.g., less than 10%, or less than 5%) respectively, may be provided. Unjacketed lamps formed according to this embodiment may have a CCT of at least 9000K, a color rendering index of at least 75, and an efficacy of at least 55 lm/W, and a power consumption of at least 400 W. In this embodiment, the arc gap may be about 4 mm. This produces a bright source for efficient light collection by the fixture.

In a fourth exemplary embodiment, the fill includes halides of dysprosium (e.g., one or more of dysprosium, thulium and holmium), neodymium, cesium and indium. Other halides (other than mercury) may account for a total of less than 10 mol % of the fill, e.g., less than about 5%, and in one embodiment, about 0%. In this embodiment, the molar ratio of dysprosium to neodymium may be from about 2.6:2 to about 3.4:2, e.g., about 3:2, the ratio of dysprosium to cesium at least 3:2, and the ratio of dysprosium to indium from about 0.8:4 to about 1.4:4, e.g., about 1:4. For example, a fill comprising dysprosium, neodymium, cesium, and indium at concentrations of about 0.25, 0.17, 0.16, and 1.03 μmol/cm$^3$ (e.g., in which each of these concentrations may vary by no more than ±15%, e.g., less than 10%, or less than 5%) respectively, may be provided. Unjacketed lamps formed according to this embodiment may have a CCT of at least 7000K, a color rendering index of at least 70, and an efficacy of at least 70 lm/W.

In a fifth exemplary embodiment, the fill includes halides of dysprosium (e.g., one or more of dysprosium, thulium and holmium), neodymium, cesium and indium. Other halides (other than mercury) may account for a total of less than 10 mol % of the fill, e.g., less than about 5%, and in one embodiment, about 0%. In this embodiment, the molar ratio of dysprosium to neodymium may be about 2.7:5 to about 3.3:5, e.g., about 3:5, the ratio of dysprosium to cesium at least 3:2, and the ratio of dysprosium to indium about 1:15 to about 1:20, e.g., about 1:19. For example, a fill comprising dysprosium, neodymium, cesium, and indium at concentrations of about 0.16, 0.29, 0.11, and 3.08 μmol/cm$^3$ (e.g., in which each of these concentrations may vary by no more than ±15%, e.g., less than 10%, or less than 5%) respectively, may be provided. Unjacketed lamps formed according to this embodiment may have a CCT of at least 9000K, a color rendering index of at least 80, and an efficacy of at least 55 lm/W.

In one embodiment, the fill is substantially free (less than about 1 mol %, e.g., less than 0.1 mol %) of hafnium halides. In one embodiment, the fill is substantially free (less than about 1 mol %, e.g., less than 0.1 mol %) of nickel halides.

In operation, a voltage is applied between the electrodes, for example by connecting the electrodes with a source of power via a suitable ballast, such as an electronic ballast. A discharge is created between the electrodes and visible light is emitted from the lamp. Stable operation occurs shortly thereafter, at which time, stable measurements of CRI, CCT, and efficacy can be made.

Without intending to limit the scope of the invention, the following examples demonstrate the properties of fill compositions formulated according to the exemplary embodiments.

EXAMPLES

Lamps were formed having a discharge vessel configured as shown in FIG. 1 with an arc gap of 3-7 mm. The arc tube had an interior volume of 0.70-2.57 cc. The lamps were filled with a fill comprising mercury 16-65 (mg), a halide component (all bromides), as indicated in Examples 1 to 8 in Tables 1 and 2, back filled with Ar to a pressure of 50-200 torr, and pinch sealed. None of the lamps had outer jackets. Tables 1 and 2 show the value of R which satisfies $$\frac{X+Y}{P_{ARC}\Sigma} > R$$

as well as CCT, Ra, and luminous efficacy values, which were obtained using standard photometry with an integrating sphere while operating the lamp at rated power. Lamp power ranged from 400-1200 W. The lamps were allowed to warm up for at least about 15 minutes before measuring.

TABLE 1

| Halide (Bromide) | Example 1 μmols | Example 1 mol % | Example 2 μmols | Example 2 mol % | Example 3 μmols | Example 3 mol % | Example 4 μmols | Example 4 mol % |
|---|---|---|---|---|---|---|---|---|
| Dysprosium | 0.398 | 30.0 | 0.49 | 18.2 | 0.245 | 11.6 | 0.245 | 9.4 |
| Gadolinium | 0.504 | 38.0 | 0.504 | 18.7 | 0.504 | 23.8 | 1.0 | 38.3 |
| Neodymium | 0 | 0 | 0.35 | 13.0 | 0.173 | 8.2 | 0.173 | 6.6 |
| Total of Gd + Nd | 0.504 | 38 | 0.854 | 31.7 | 0.617 | 32 | 1.173 | 44.9 |
| Total of Gd, Dy, and Nd | 0.902 | 68.0 | 1.344 | 49.9 | 0.922 | 43.6 | 1.418 | 54.3 |
| Cesium | 0.188 | 14.2 | 0.325 | 12.0 | 0.166 | 5.5 | 0.166 | 7.8 |
| Indium | 0.236 | 17.8 | 1.027 | 38.1 | 1.027 | 48.6 | 1.027 | 39.3 |
| Thallium | 0 | 0 | 0 | 0 | 0 | 0 | 0 | 0 |
| Total mol halide | 1.326 | 100 | 2.696 | 100 | 2.115 | 100 | 2.611 | 100 |
| Lamp Volume (cc) | 1.15 | | 0.70 | | 0.70 | | 0.70 | |
| Wall loading, $W/mm^2$ | 4.285 | | 3.86 | | 3.86 | | 3.86 | |
| R, Eqn 1 | 0.13 | | 0.15 | | 0.19 | | 0.20 | |
| CRI, Ra | 70 | | 76 | | 72 | | 72 | |
| CCT, K | 7200 | | 9200 | | 11,200 | | 10,900 | |
| Efficacy, lm/W | 82 | | 60 | | 55 | | 58 | |

TABLE 2

| Halide (Bromide) | Example 5 μmols | Example 5 mol % | Example 6 μmols | Example 6 mol % | Example 7 μmols | Example 7 mol % | Example 8 μmols | Example 8 mol % |
|---|---|---|---|---|---|---|---|---|
| Dysprosium | 0.8 | 23.6 | 1.59 | 24.8 | 0.245 | 15.2 | 0.164 | 4.5 |
| Gadolinium | 1.51 | 44.5 | 3.02 | 47.1 | 0 | 0 | 0 | 0 |
| Neodymium | 0 | 0 | 0 | 0 | 0.173 | 10.8 | 0.286 | 7.9 |
| Total of Gd + Nd | 1.51 | 44.5 | 3.02 | 47.1 | 0.173 | 10.8 | 0.286 | 7.9 |
| Total of Gd, Dy, Nd | 2.31 | 68.1 | 4.61 | 71.9 | 0.418 | 26 | 0.450 | 12.4 |
| Cesium | 0.38 | 11.2 | 0.75 | 11.7 | 0.16 | 10.0 | 0.113 | 3.1 |
| Indium | 0 | 0 | 0 | 0 | 1.03 | 64.1 | 3.08 | 84.5 |
| Thallium | 0.704 | 20.7 | 1.05 | 16.4 | 0 | 0 | 0 | 0 |
| Total of In, Tl | 0.704 | 20.7 | | 16.4 | | 64.1 | 3.08 | 84.5 |
| Total mol halide | 3.387 | 100 | 6.41 | 100 | 1.608 | 100 | 3.645 | 100 |
| Lamp volume (cc) | 2.572 | | 2.572 | | 1.15 | | .70 | |
| Wall loading, $W/mm^2$ | 3.21 | | 3.21 | | 4.285 | | 3.86 | |
| R, Eqn 1 | 0.20 | | 0.20 | | 0.15 | | 0.22 | |
| CRI, Ra | 82 | | 84 | | 71 | | 81 | |
| CCT, K | 7500 | | 7200 | | 7300 | | 9300 | |
| Efficacy, lm/W | 88 | | 88 | | 66 | | 60 | |

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:

a discharge vessel;

electrodes extending into the discharge vessel; and a discharge sustaining fill sealed within the discharge vessel, the fill comprising:

mercury;

an inert gas; and a halide component comprising:

0.12-0.5 $\mu mol/cm^3$ of cesium halide, a total of 0.1-1.6 $\mu mol/cm^3$ of at least one of indium halide and thallium halide, a total of 0.3-1.5 $\mu mol/cm^3$ of at least one rare earth halide selected from dysprosium halide, holmium halide, neodymium halide and thulium halide, and 0.30-2.0 $\mu mol/cm^3$ of gadolinium halide;

a total of less than 0.2 $\mu mol/cm^3$ of halides other than cesium, gadolinium, thallium, indium, dysprosium, holmium, thulium, mercury, and neodymium, and wherein in operation without a jacket at an arc wall loading of at least 2 $watts/mm^2$, the lamp has a color temperature of from 7000K to 14,000K and a color rendering index (Ra) of at least 70.

2. The lamp of claim 1, wherein the discharge vessel is free of a jacket.

3. A lamp comprising:

a discharge vessel;

electrodes extending into the discharge vessel; and a discharge sustaining fill sealed within the discharge vessel, the fill comprising:

mercury;

an inert gas; and a halide component comprising:

cesium halide, at least one of indium halide and thallium halide, and a rare earth halide component comprising at least one of dysprosium halide, holmium halide, neodymium halide and thulium halide, and gadolinium halide;

wherein in operation without a jacket at an arc wall loading of at least 2 watts/mm$^2$, the lamp has a color temperature of from 7000K so 14,000K and a color rendering index (Ra) of at least 70;

and wherein:

$$\frac{Gd + Y}{P_{ARC}\Sigma} > R$$

where Gd=the moles of gadolinium halide in the fill;

Y=In+Tl, where In=the moles of indium halide in the fill and Tl=the moles of thallium halide in the fill;

$P_{ARC}$ is the arc wall loading in W/mm$^2$;

Σ=the total moles of metal halide in the fill; and

R≧0.1 mm$^2$/W.

4. The lamp of claim 3, wherein: at least one of the following is satisfied, (a) Gd≧2Y,In>Tl, and R=0.1;

(b) Gd≦1.8Y,In>Tl, and R=0.15; and (c) Gd≦2Y,In>Tl, and R=0.15.

5. The lamp of claim 4, wherein at least one of Gd=0 and Tl=0.

6. The lamp of claim 3, wherein $P_{ARC}$≧3 W/mm$^2$.

7. The lamp of claim 3, wherein R≧0.13 mm$^2$/W.

8. The lamp of claim 1, wherein the rare earth halide includes neodymium.

9. The lamp of claim 1, wherein the rare earth halide component includes at least one of dysprosium and neodymium.

10. The lamp of claim 9, wherein the rare earth halide component includes gadolinium, dysprosium, and neodymium.

11. A lamp comprising:

a discharge vessel;

electrodes extending into the discharge vessel; and a discharge sustaining fill sealed within the discharge vessel, the fill comprising:

mercury;

an inert gas; and a halide component comprising:

cesium halide, at least one of indium halide and thallium halide, and a rare earth halide component comprising at least one of dysprosium halide, holmium halide, neodymium halide and thulium halide, and optionally gadolinium halide; and wherein the fill comprises less than 10 mole percent of halides other than halides of dysprosium, cesium, gadolinium, thallium, indium, and neodymium; and wherein in operation without a jacket at an arc wall loading of at least 2 watts/mm$^2$, the lamp has a color temperature of from 7000K to 14,000K and a color rendering index (Ra) of at least 70.

12. The lamp of claim 1, wherein in operation, the color temperature is at least 7500K.

13. The lamp of claim 12, wherein in operation, the color temperature is at least 9,000K.

14. The lamp of claim 13, wherein the fill is substantially free of thallium.

15. The lamp of claim 11 wherein the fill comprises:

0.12-0.5 μmol/cm$^3$ of cesium halide;

0.30-2.0 μmol/cm$^3$ of gadolinium halide;

a total of 0.1-1.6 μmol/cm$^3$ of at least one of indium halide and thallium halide;

a total of 0.3-1.5 μmol/cm$^3$ of at least one rare earth halide selected from dysprosium, neodymium, holmium, and thulium; and a total of less than 0.2 μmol/cm$^3$ of halides other than cesium, gadolinium, thallium, indium, dysprosium, holmium, thulium, mercury, and neodymium.

16. A lamp, comprising:

a discharge vessel;

electrodes extending into the discharge vessel; and a discharge sustaining fill sealed within the discharge vessel, the fill comprising: mercury;

an inert gas; and a halide component comprising:

cesium halide, at least one of indium halide and thallium halide, and a rare earth halide component comprising at least one of dysprosium halide, holmium halide, neodymium halide and thulium halide, and wherein:

$$0.2 \le \frac{Re}{(Gd + In + Tl)} \le 2.0$$

wherein: Re=moles of rare earth halides in the fill selected from the group consisting of dysprosium, neodymium, holmium, and thulium halides, and combinations thereof;

Gd=moles of gadolinium halides in the fill,

In=moles of indium halides in the fill, and

Tl=moles of thallium halides in the fill, wherein in operation without a jacket at an arc wall loading of at least 2 watts/mm$^2$, the lamp has a color temperature of from 7000K to 14,000K and a color rendering index (Ra) of at least 70.

17. A lamp comprising:

a discharge vessel;

electrodes extending into the discharge vessel; and a discharge sustaining fill sealed within the discharge vessel, the fill comprising:

mercury;

an inert gas; and a halide component comprising:

cesium halide, at least one of indium halide and thallium halide, and a rare earth halide component comprising at least one of dysprosium halide, holmium halide, neodymium halide and thulium halide, and optionally gadolinium halide; and wherein the halide component in the fill satisfies following molar ratio:

$$0.38 \leq \frac{Cs}{Re} \leq 0.48$$

wherein Cs=moles of cesium halides in the fill; and

Re=moles of rare earth halides in the fill and;

wherein in operation without a jacket at an arc wall loading of at least 2 watts/mm$^2$, the lamp has a color temperature of from 7000K to 14,000K and a color rendering index (Ra) of at least 70.

18. The lamp of claim 1, wherein the fill comprises: 0.12-0.25 μmol/cm$^3$ of cesium halide; less than 0.3 μmol/cm$^3$ of gadolinium halide; a total of 0.8-4.5 μmol/cm$^3$ of at least one of indium and thallium halide; a total of 0.30-0.8 μmol/cm$^3$ of at least one rare earth halide selected from dysprosium, neodymium, holmium, and thulium halide; and a total of less than 0.2 μmol /cm$^3$ of halides other than cesium, gadolinium, thallium, indium, dysprosium, holmium, thulium, mercury and neodymium.

19. The lamp of claim 1 wherein the fill comprises less than 10 mole percent of halides other than halides of cesium, gadolinium, thallium, indium, dysprosium, holmium, thulium, mercury, and neodymium.

20. A method of operating the lamp of claim 1, comprising: supplying electrical power to the lamp to provide an arc wall loading of at least 2 watts/mm$^2$, whereby the lamp has a color temperature of from 7000K to 14,000K and a color rendering index (Ra) of at least 70.

* * * * *